US008446354B2

(12) United States Patent
Huang et al.

(10) Patent No.: US 8,446,354 B2
(45) Date of Patent: May 21, 2013

(54) LIQUID CRYSTAL DISPLAY CAPABLE OF COMPENSATING COMMON VOLTAGE SIGNAL THEREOF

(75) Inventors: Shun-Ming Huang, Shenzhen (CN); An Shih, Miao-Li (TW)

(73) Assignees: Innocom Technology (Shenzhen) Co., Ltd, Shenzhen, Guangdong Province (CN); Chimei Innolux Corporation, Miaoli County (TW)

( * ) Notice: Subject to any disclaimer, the term of this patent is extended or adjusted under 35 U.S.C. 154(b) by 1172 days.

(21) Appl. No.: 12/157,015

(22) Filed: Jun. 6, 2008

(65) Prior Publication Data

US 2008/0303967 A1 Dec. 11, 2008

(30) Foreign Application Priority Data

Jun. 8, 2007 (CN) ..... 2007 1 0074774

(51) Int. Cl.
*G09G 3/36* (2006.01)

(52) U.S. Cl.
USPC ..... 345/90; 345/94

(58) Field of Classification Search
USPC ..... 345/87–104
See application file for complete search history.

(56) References Cited

U.S. PATENT DOCUMENTS

| | | | | |
|---|---|---|---|---|
| 5,686,932 | A * | 11/1997 | Tomita | 345/94 |
| 5,831,605 | A | 11/1998 | Yasui et al. | |
| 2002/0101415 | A1* | 8/2002 | Song | 345/211 |
| 2005/0253836 | A1* | 11/2005 | Kim et al. | 345/212 |
| 2007/0024560 | A1 | 2/2007 | Kim et al. | |

FOREIGN PATENT DOCUMENTS

CN 1908741 A 2/2007

* cited by examiner

*Primary Examiner* — Jimmy H Nguyen
(74) *Attorney, Agent, or Firm* — Muncy, Geissler, Olds & Lowe, PLLC

(57) ABSTRACT

An exemplary liquid crystal display (200) includes a liquid crystal panel (201) having a plurality of pixel units (240), a scanning circuit (202) configured to activate the pixel units, a data circuit (203) configured to provide data voltage signals the pixel unit via a plurality of data lines (220), and a common voltage circuit (205) configured to generate a common voltage signal. Each pixel unit includes a pixel electrode (242), a common electrode (243), and a coupling member (245). The coupling member is connected between the pixel electrode and a corresponding one of the data lines, and is configured to transfer an electrical potential shift of the corresponding common electrode to the corresponding data line when one of the data voltage signals is applied to the pixel electrode. The common voltage circuit is configured to compensate the common voltage signal according to a feedback signal obtained from the data lines.

19 Claims, 3 Drawing Sheets

LIQUID CRYSTAL DISPLAY CAPABLE OF COMPENSATING COMMON VOLTAGE SIGNAL THEREOF

FIELD OF THE INVENTION

The present invention relates to liquid crystal displays (LCDs), and more particularly to an LCD capable of compensating a common voltage signal thereof.

GENERAL BACKGROUND

LCDs are widely used in various electronic information products, such as notebooks, personal digital assistants, video cameras, and the like.

FIG. 4 is an abbreviated circuit diagram of a conventional LCD. The LCD 100 includes a liquid crystal panel 101, a scanning circuit 102, and a data circuit 103. The liquid crystal panel 101 includes n rows of parallel scanning lines 110 (where n is a natural number), m columns of parallel data lines 120 perpendicular to the scanning lines 110 (where m is also a natural number), and a plurality of pixel units 140 cooperatively defined by the crossing scanning lines 110 and data lines 120. The pixel units 140 are arranged in a matrix. The scanning lines 110 are connected to the scanning circuit 102, and the data lines 120 are connected to the data circuit 130.

Each pixel unit 140 includes a thin film transistor (TFT) 141, a pixel electrode 142, and a common electrode 143. A gate electrode of the TFT 141 is connected to a corresponding one of the scanning lines 110, and a source electrode of the TFT 141 is connected to a corresponding one of the data lines 120. Further, a drain electrode of the TFT 141 is connected to the pixel electrode 142. The common electrodes 143 of all the pixel units 140 are connected together and further connected to a common voltage generating circuit (not shown). In each pixel unit 140, liquid crystal molecules (not shown) are disposed between the pixel electrode 142 and the common electrode 143, so as to cooperatively form a liquid crystal capacitor 147.

In operation, the common electrodes 143 receive a common voltage signal from the common voltage generating circuit. The scanning circuit 102 provides a plurality of scanning signals to the scanning lines 110 sequentially, so as to activate the pixel units 140 row by row. The data circuit 103 provides a plurality of data voltage signals to the pixel electrodes 142 of the activated pixel units 140. Thereby, the liquid crystal capacitors 147 of the activated pixel units 140 are charged. After the charging process, an electric field is generated between the pixel electrode 142 and the common electrode 143 in each pixel unit 140. The electric field drives the liquid crystal molecules to control light transmission of the pixel unit 140, such that the pixel unit 140 displays a particular color (red, green, or blue) having a corresponding gray level. The electric field is maintained by the liquid crystal capacitor 147 during a so-called current frame period, and accordingly the gray level of the color is maintained during the current frame period.

In the LCD 100, each pixel unit 140 employs a capacitor structure (i.e. the liquid crystal capacitor 147) to maintain the gray level of the color. In addition, a plurality of parasitic capacitors usually exist in the pixel unit 140. Due to a so-called capacitor coupling effect, when the data voltage signal received by the pixel electrode 142 changes, an electrical potential of the common electrode 143 may be coupled and shift from the common voltage signal.

The shift of the electrical potential of the common electrode 143 may further bring on a change of the electric field between the pixel electrode 142 and the common electrode 143. Thereby, the gray level of the color displayed by the pixel unit 140 is apt to change, and accordingly a so-called color shift phenomenon may be generated. Thus the display quality of the LCD 100 may be somewhat unsatisfactory.

What is needed is to provide an LCD that can overcome the above-described deficiencies.

SUMMARY

In a first aspect, a liquid crystal display includes a liquid crystal panel having a plurality of pixel units, a scanning circuit configured to activate the pixel units, a data circuit configured to provide data voltage signals the pixel unit via a plurality of data lines, and a common voltage circuit configured to generate a common voltage signal. Each pixel unit includes a pixel electrode, a common electrode, and a coupling member. The coupling member is connected between the pixel electrode and a corresponding one of the data lines, and is configured to transfer an electrical potential shift of the corresponding common electrode to the corresponding data line when one of the data voltage signals is applied to the pixel electrode. The common voltage circuit is configured to compensate the common voltage signal according to a feedback signal obtained from the data lines.

In a second aspect, a liquid crystal display includes a plurality of pixel units, a scanning circuit configured to activate the pixel units, a data circuit configured to provide data voltage signal to the activated pixel units, and a common voltage circuit configured to generate a common voltage signal. Each pixel unit includes a coupling member. The coupling member is configured to generated a respective coupling signal according to one of the data voltage signals that is applied to the corresponding activated pixel unit, and superpose the coupling signal to the data voltage signal to form a superposing signal. All the superposing signals cooperatively form a feedback signal. The common voltage circuit is configured to adjust a reference voltage signal according to the feedback signal, and provide the adjusted reference voltage signal as the common voltage signal to the pixel units.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
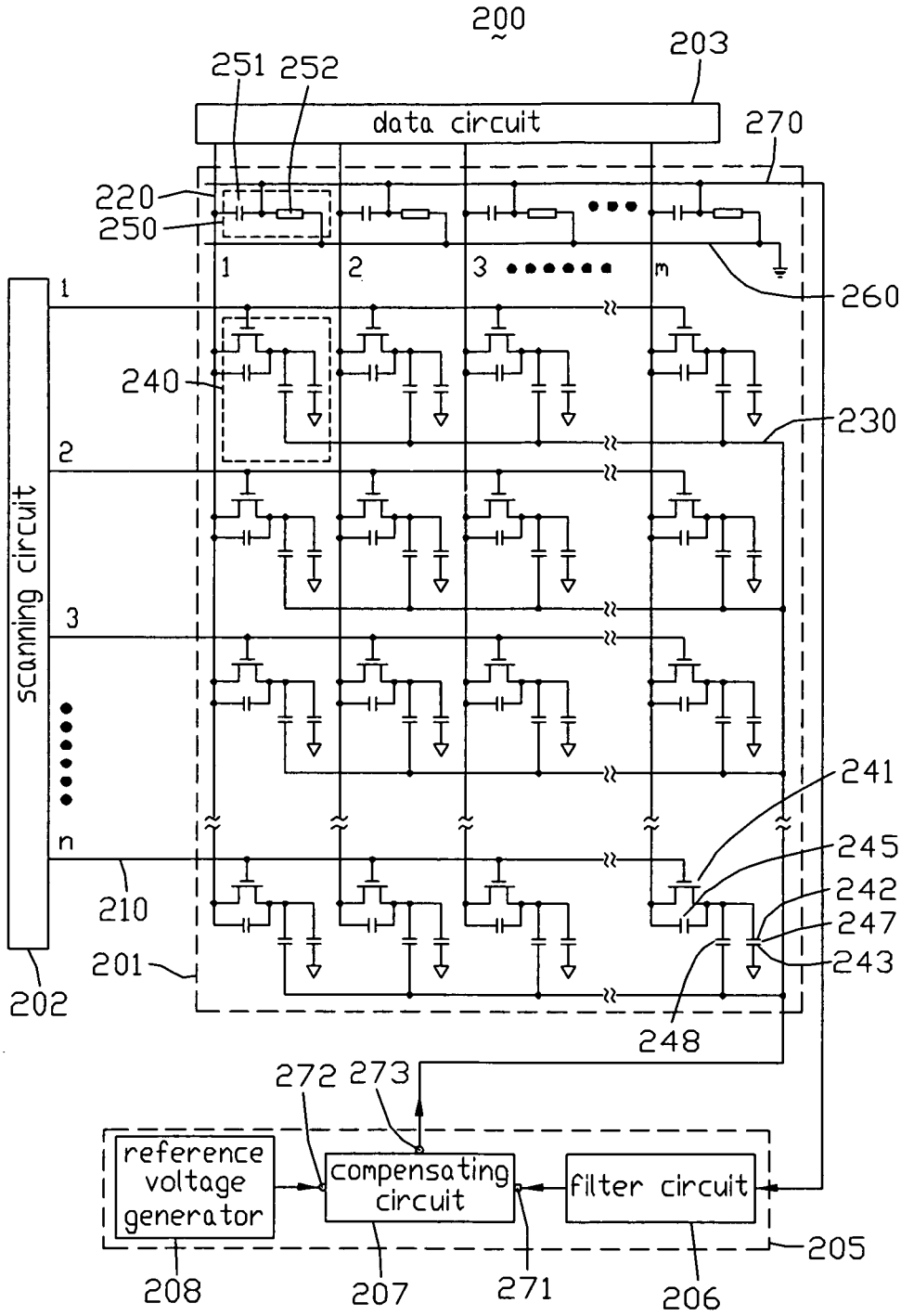
FIG. 1 is essentially an abbreviated circuit diagram of an LCD according to an exemplary embodiment of the present invention, the LCD including a compensating circuit and a liquid crystal panel, the liquid crystal panel including a feedback line, a ground line, a plurality of data lines, and a plurality of signal process units.

FIG. 1 is an abbreviated circuit diagram of an LCD according to an exemplary embodiment of the present invention. The LCD 200 includes a liquid crystal panel 201, a scanning circuit 202, a data circuit 203, and a common voltage circuit 205.

The liquid crystal panel 201 includes n rows of parallel scanning lines 210 (where n is a natural number), n rows of parallel common lines 230 alternately arranged with the scanning lines 210, m columns of parallel data lines 220 perpendicular to the scanning lines 210 and the common lines 230 (where m is also a natural number), and a plurality of pixel units 240 cooperatively defined by the crossing scanning lines 210 and data lines 220. Thus, the pixel units 240 are arranged in a matrix having n rows and m columns. The scanning lines 210 are connected to the scanning circuit 202 to receive scanning signals. The data lines 220 are connected to the data circuit 203 to receive data voltage signals. The liquid crystal panel 201 further includes a liquid crystal layer having a plurality of the liquid crystal molecules.

Each pixel unit 240 includes a TFT 241, a pixel electrode 242, a common electrode 243, a storage capacitor 248, and a coupling capacitor 245. A gate electrode of the TFT 241 is connected to a corresponding one of the scanning lines 210, and a source electrode of the TFT 241 is connected to a corresponding one of the data lines 220. Further, a drain electrode of the TFT 241 is connected to the pixel electrode 242. The common electrode 243 is generally opposite to the pixel electrode 242, with a plurality of the liquid crystal molecules (not shown) sandwiched therebetween, so as to cooperatively form a liquid crystal capacitor 247. The coupling capacitor 245 is connected between the pixel electrode 242 and the corresponding one of the data lines 220. The storage capacitor 248 is connected between the pixel electrode 242 and the corresponding one of the common lines 230. In particular, a capacitance of the coupling capacitor 245 is the same as a sum of capacitances of the corresponding storage capacitor 248 and liquid crystal capacitor 247.

The liquid crystal panel 201 further includes a ground line 260, a feedback line 270, and a plurality of signal process units 250. The ground lines 260 and the feedback line 270 are both perpendicular to the data lines 220, and are disposed at an edge of the liquid crystal panel 201 adjacent to the data circuit 203. A row of rectangular dummy regions are cooperatively defined by the crossing data lines 220, ground line 260, and feedback line 270. Each of the dummy regions includes a respective signal process unit 250.

Each of the signal process units 250 can for example be a differentiator capable of carrying out a differential calculation and converting a square wave to a corresponding cusp wave. In particular, the signal process unit 250 includes a differential capacitor 251 and a differential resistor 252. The differential capacitor 251 is connected between the feedback line 270 and the corresponding one of the data lines 220. The differential resistor 252 is connected between the feedback line 270 and the ground line 260.

Figure 2:
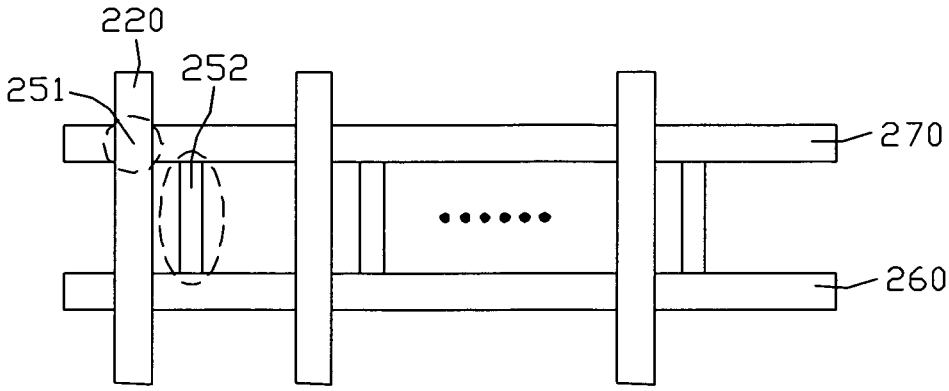
FIG. 2 is an enlarged, schematic view of part of the liquid crystal panel of FIG. 1, showing details of an exemplary one of the signal process units, which is formed between the feedback line, the ground line, and one of the data lines.

Referring also to FIG. 2, each of the differential capacitors 251 can be in a form of a parasitic capacitor formed by the corresponding data line 220 and the feedback line 270 due to a superposition thereof. Each of the differential resistors 252 can employ a parasitic resistor of a metal wire (not labeled) connecting the feedback line 270 to the ground line 260 in the corresponding dummy region.

The common voltage circuit 205 is configured for providing a common voltage signal to the pixel units 240. The common voltage circuit 205 includes a filter circuit 206, a compensating circuit 207, and a reference voltage generator 208. The filter circuit 206 can for example be a synchronous filter, which is configured for filtering a feedback signal transmitted by the feedback line 270 and thereby generating a control signal. The reference voltage generator 208 is configured to provide a reference voltage signal to the compensating circuit 207. The compensating circuit 207 is configured to adjust the reference voltage signal according to the control signal outputted by the filter circuit 206, and thereby generate a corresponding common voltage signal.

Figure 3:
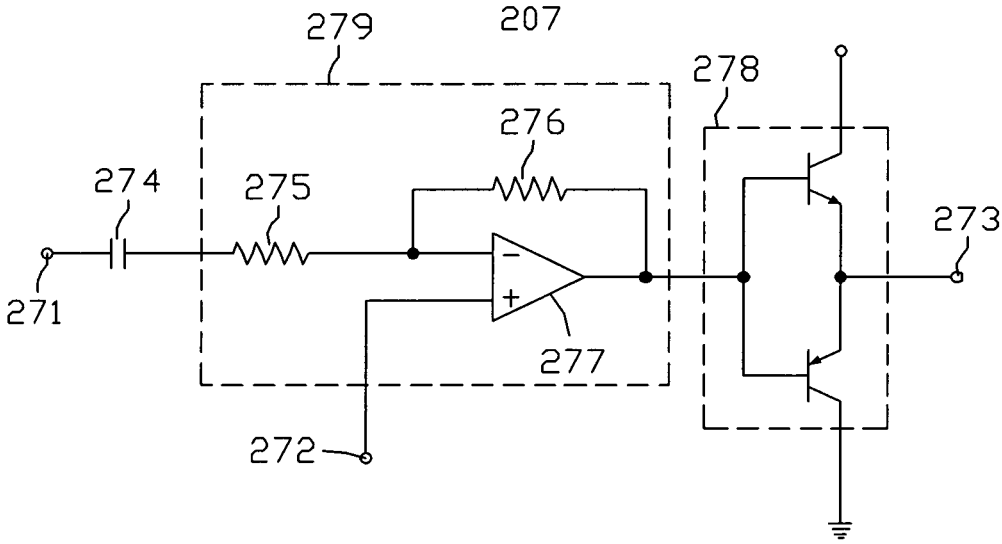
FIG. 3 is a diagram of the compensating circuit of the LCD of FIG. 1.
Figure 4:
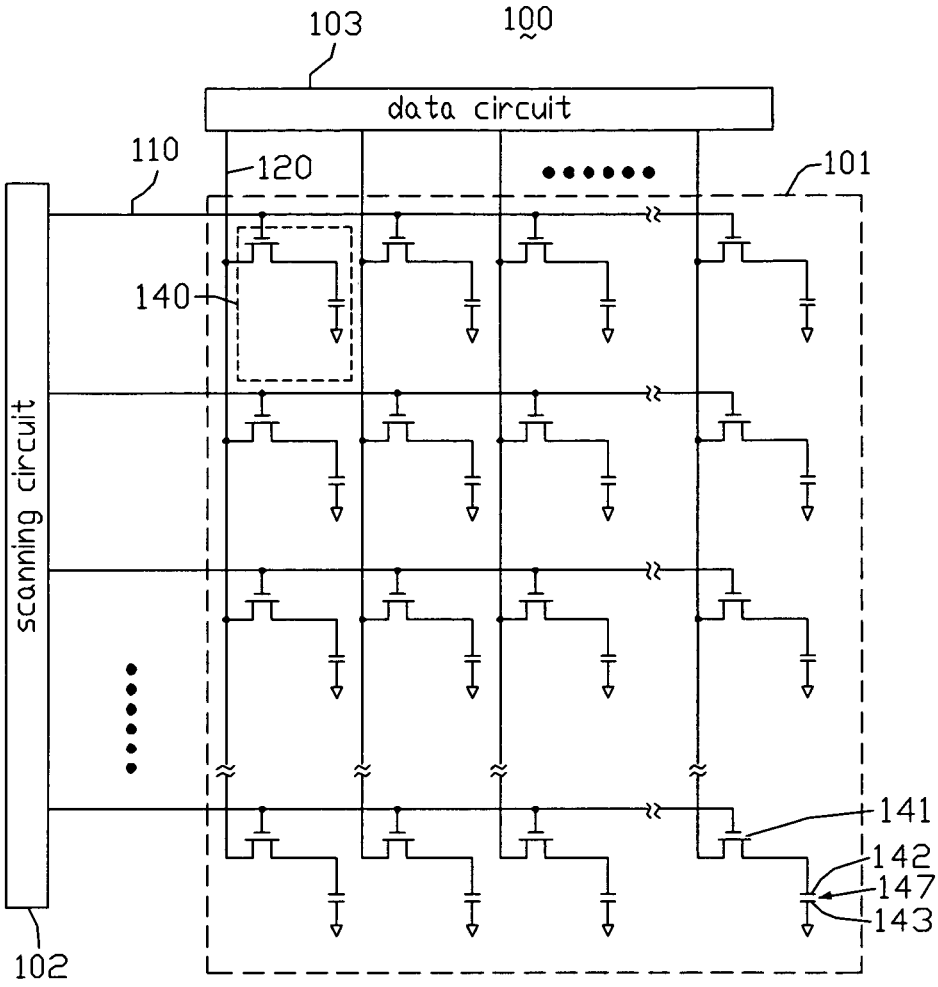
FIG. 4 (RELATED ART)
FIG. 4 is essentially an abbreviated circuit diagram of a conventional LCD.

Referring also to FIG. 3, the compensating circuit 207 includes a first input terminal 271, a second input terminal 272, a filter capacitor 274, a voltage adjusting circuit 279, an output circuit 278, and an output terminal 273. The first input terminal 271 is configured for receiving the control signal from the filter circuit 206. The second input terminal 272 is configured for receiving the reference voltage signal from the reference voltage generator 208. The output terminal 273 is configured to output the common voltage signal to the common lines 230 and the common electrodes 243 of the pixel units 240.

The filter capacitor 274 is connected between the input terminal 271 and the voltage adjusting circuit 279, and is configured for filtering direct current (DC) components of the control signal. The voltage adjusting circuit 279 includes an integrated operational amplifier (IOA) 277 connected in a negative feedback arrangement. In detail, a non-inverting terminal of the IOA 277 is connected to the second input terminal 272. An inverting terminal of the IOA 277 is connected to the filter member 274 via a first resistor 275, and is connected to an output terminal of the IOA 277 via a second resistor 276. The output terminal of the IOA 277 is further connected to the output terminal 273 via the output circuit 278. The output circuit 278 employs a so-called complementary circuit, so as to reduce an output resistance of the compensating circuit 207.

Typical operation of the LCD 200 is as follows. First of all, the reference voltage generator 257 generates and outputs a reference voltage signal to the compensating circuit 207 via the second input terminal 272 thereof. In the compensating circuit 207, the IOA 277 treats the reference voltage signal as a predetermined common voltage signal, and outputs the predetermined common voltage signal to the common lines 230 and the common electrodes 243 of the pixel unit 240 via the output circuit 278.

The scanning circuit 202 provides a plurality of scanning signals, and outputs the scanning signals to the scanning lines 210 sequentially. The scanning signals activate the pixel units 240 row by row via switching the corresponding TFTs 241 on.

The data circuit 203 provides a plurality of data voltage signals, and outputs the data voltage signals to the pixel electrodes 242 of the corresponding activated pixel units 240 via the data lines 220 and the corresponding TFTs 241. Once a given data voltage signal is received by the pixel electrode 242 of a corresponding pixel unit 240, due to a capacitor coupling effect, a first interference voltage signal $V_{IF1}$ is cooperatively generated in the common electrode 243 by the liquid crystal capacitor 247 and the storage capacitor 248. Thereby, an electrical potential of the common electrode 243 is coupled and shifts.

The first interference voltage signal $V_{IF1}$ is an alternating current (AC) cusp wave signal. In detail, assuming that the given data voltage signal applied to the pixel electrode 242 of the pixel unit 240 in the current frame period is $V_N$, and a data voltage signal applied to the pixel electrode 242 of the pixel unit 240 in the previous frame period is $V_{N-1}$, a primary value of the first interference voltage signal $V_{IF1}$ can be calculated by the equation $\Delta V=V_N-V_{N-1}$ (i.e. a change of the data voltage signals applied thereto), and an absolute value of the first interference voltage signal $V_{IF1}$ drops gradually in an exponential manner. In summary, the first interference voltage signal $V_{IF1}$ can be expressed by the following equation $V_{IF1}=\Delta V*(1-e^{-t/\tau})$, where the symbol $\tau$ represents a time constant, and the symbol t represents a time period.

Because the pixel units 240 are activated and receive the data voltage signals row by row, electrical potentials of the common electrodes 243 in the activated row of pixel units 240 shift simultaneously. That is, each common electrode 243 of the activated row of pixel units 240 has a respective first interference voltage signal $V_{IF1}$ generated therein. In addition, the common electrodes 243 in the activated row of pixel units 240 are connected together. Thereby, all the first interference voltage signals $V_{IF1}$ are averaged, so as to cooperatively form a first coupling signal $V_{CP1}$. The first coupling signal $V_{CP1}$ further superposes the predetermined common voltage signal, such that a first superposing signal is formed in the common electrodes 243.

Similarly, due to a capacitor coupling effect of the coupling capacitor 245, an electrical potential of the source electrode of the TFT 241 of each activated pixel unit 240 is also coupled and shifts, and accordingly a second interference voltage signal $V_{IF2}$ is generated in the source electrode of the TFT 241. Because the second interference voltage signal $V_{IF2}$ also results from the changing of the data voltage signal applied to the pixel electrode 242, it is substantially equal to the first interference voltage signal $V_{IF1}$.

Because the pixel units 240 are activated row by row via the corresponding scanning lines 210, electrical potentials of the source electrodes of the TFTs 241 in each activated row of pixel units 240 shift simultaneously. That is, each of the source electrodes in the activated row has a respective second interference voltage signal $V_{IF2}$ generated therein. Each second interference voltage signal $V_{IF2}$ superposes the corresponding data voltage signal, thereby forming a respective second superposing signal in the source electrode of the corresponding TFT 241. In particular, such second superposing signal includes a first cusp wave part formed by the second interference voltage signal $V_{IF2}$ and a square wave part formed by the corresponding data voltage signal. The second superposing signal is then transmitted to the corresponding signal process units 250 via the corresponding data line 220.

Each signal process unit 250 carries out a differential calculation for the corresponding second superposing signal via cooperation of the differential capacitor 251 and the differential resistor 252. The differential calculation has little influence on the first cusp wave part. However, the square wave part of the second superposing signal is converted to a second cusp wave part that is independent from the first cusp wave part. Thereby, each of the second superposing signals is converted to a third superposing signal having two independent cusp wave parts. The feedback line 270 receives and averages all the third superposing signals therein, such that a feedback signal $V_{FB}$ having an averaged first cusp wave part and an averaged second cusp wave part is cooperatively formed in the feedback line 270, and further transmitted to the common voltage circuit 205.

In the common voltage circuit 205, the feedback signal $V_{FB}$ is synchronously filtered by the filter circuit 206, such that the averaged second cusp wave part is eliminated, and the averaged first cusp wave part of the feedback signal $V_{FB}$ is extracted. The averaged first cusp wave part serves as a control signal, and is outputted to the compensating circuit 207.

In the compensating circuit 207, the control signal is further filtered by the filter member 274, such that DC components thereof that might be induced during the synchronous filtering process are eliminated. The IOA 277 compares the reference voltage signal with the filtered control signal, and further adjusts the reference voltage signal according to a result of the comparison, so as to generate an adjusted common voltage signal. The adjusted common voltage signal replaces the predetermined common voltage signal, and is outputted to the common lines 230 and the common electrodes 243 of the pixel units 240 via the output circuit 278.

The data voltage signals, together with the adjusted common voltage signal, charge the storage capacitors 248 of the activated row of pixel units 240. In addition, the data voltage signals, together with the adjusted common voltage signal, charge the corresponding liquid crystal capacitors 247. Thereby, an electric field is generated between the pixel electrode 242 and the common electrode 243 in each pixel unit 240 after the charging process. The electric field drives the liquid crystal molecules of the pixel unit 240 to control the light transmission of the pixel unit 240, such that the pixel unit 240 displays a particular color (e.g., red, green, or blue) having a corresponding gray level; and such gray level is maintained by cooperation of the storage capacitor 248 and liquid crystal capacitor 247. The aggregation of colors displayed by all the pixel units 240 simultaneously constitutes an image viewed by a user of the LCD 200.

In the LCD 200, a plurality of coupling capacitors 245 are provided in the pixel units 240 of the liquid crystal panel 201. Due to the coupling capacitors 245, an electrical potential coupling in the common electrode 243 of each pixel unit 240 is transferred to the corresponding data line 220, and the shift of the common voltage signal is transferred to a shift of the data voltage signal. The feedback line 270 feeds back the shift of the data voltage signal to the common voltage circuit 205, and the common voltage circuit 205 further adjusts the reference voltage signal according to the feedback signal $V_{FB}$, such that the shift of the common voltage signal is compensated. Thereby, the electric field between the pixel electrode 242 and the common electrode 243 of each pixel unit 240 is stable during the current frame period.

In addition, because the feedback signal $V_{FB}$ is obtained from the data lines 220, the feedback signal $V_{FB}$ is independent from the adjusted common voltage signal. By employing such feedback signal $V_{FB}$, the compensation of the common voltage signal is more reliable. Therefore, the gray level of the color displayed by the pixel unit 240 is more stable. Accordingly, any color shift phenomenon that might be otherwise induced because of the capacitor coupling effect is diminished or even eliminated, and the display quality of the LCD 200 is improved.

Furthermore, all the primary data voltage signals are respectively converted to cusp waves by the corresponding signal process units 250 before being outputted to the feedback line 270, in order that such primary data voltage signals can be eliminated via a synchronous filtering process later on. Because each signal process unit 250 employs a parasitic capacitor and a parasitic resistor in the liquid crystal panel 201, the manufacturing of the signal process units 250 is relatively simple and inexpensive.

In alternative embodiments, the coupling capacitor 245 in each pixel unit 240 can be in the form of a parasitic capacitor between the source electrode and drain electrode of the corresponding TFT 241. Each signal process unit 250 can also employ a discrete capacitor and a discrete resistor, instead of the parasitic capacitor and the parasitic resistor respectively. The compensating circuit 207 can employ a plurality of compensating branches. In such case, the compensating branches respectively output adjusted common voltage signals generated therein to a predetermined region of the pixel units 240 in the liquid crystal panel 201.

It is to be further understood that even though numerous characteristics and advantages of preferred and exemplary embodiments have been set out in the foregoing description, together with details of structures and functions associated with the embodiments, the disclosure is illustrative only; and that changes may be made in detail (including in matters of arrangement of parts) within the principles of the invention to the full extent indicated by the broad general meaning of the terms in which the appended claims are expressed.

What is claimed is:

1. A liquid crystal display, comprising:

a plurality of pixel units;

a scanning circuit configured to activate the pixel units;

a data circuit configured to provide data voltage signals to the activated pixel units via parallel data lines;

a feedback line parallel to the data lines;

a plurality of signal processing units respectively connected to the data lines; and a common voltage circuit configured to generate a common voltage signal according to a feedback signal received via the feedback line;

wherein each pixel unit comprises a coupling member, the coupling member is configured to generate a respective coupling signal according to one of the data voltage signals that is applied to the corresponding activated pixel unit, and superpose the coupling signal to the data voltage signal to form a superposing signal comprising a first cusp wave part formed by the coupling signal and a square wave part formed by the data voltage signal, each of the signal processing units is configured to convert the square wave part of the superposing signal into a second cusp wave part that is independent from the first cusp wave part, the feedback line is configured to provide the feedback signal comprising an averaged first cusp wave part and an averaged second cusp part, to the common voltage circuit, and the common voltage circuit is configured to adjust a reference voltage signal according to the feedback signal, and provide the adjusted reference voltage signal as the common voltage signal to the pixel units.

2. The liquid crystal display of claim 1, wherein each pixel unit further comprises a pixel electrode, and the coupling member is a coupling capacitor connected between the pixel electrode and a corresponding one of data lines.

3. The liquid crystal display of claim 2, wherein each pixel unit further comprises a liquid crystal capacitor and a storage capacitor electrically coupled in parallel, a capacitance of the coupling capacitor is substantially the same as a sum of capacitances of the liquid crystal capacitor and the storage capacitor.

4. The liquid crystal display of claim 1, wherein each of the signal processing units comprises a differentiator for performing a differential calculation on the superposing signal, such that the square wave part of the superposing signal is converted into the second cusp wave part independent from the first cusp wave part of the superposing signal while the first cusp wave part of the superposing signal is bypassed.

5. The liquid crystal display of claim 4, further comprising a ground line parallel to the feedback line, wherein the signal processing units are disposed at dummy regions between the feedback line and the ground line.

6. The liquid crystal display of claim 5, wherein the differentiator comprises a differential capacitor and a differential resistor, the differential capacitor is connected between the data line and the feedback line, and the differential resistor is connected between the feedback line and the ground line.

7. The liquid crystal display of claim 6, wherein the differential capacitor is a parasitic capacitor formed by a superposition of the data line and the feedback line, and the differential resistor is a parasitic resistor of a wire configured for connecting the feedback line to the ground line.

8. The liquid crystal display of claim 1, wherein the common voltage circuit comprises a filter circuit and a compensating circuit, the filter circuit is configured to remove the averaged second cusp wave part from the feedback signal and extract the averaged first cusp wave part of the feedback signal to the compensating circuit, the compensating circuit is configured to compensate the common voltage signal according to the averaged first cusp wave part of the feedback signal.

9. A liquid crystal display, comprising:

a liquid crystal panel comprising a plurality of pixel units arranged in columns;

a scanning circuit configured to activate the pixel units;

a data circuit configured to provide data voltage signals to the activated pixel units via parallel data lines;

a plurality of signal processing units respectively connected to the data lines; and a feedback line parallel to the data lines;

wherein each pixel unit comprises a pixel electrode and a coupling element for coupling the pixel electrode to a corresponding data line;

when the data voltage signals are applied to the activated pixel units, coupling signals resulted from the data voltage signals are generated by the coupling elements and imposed on the data lines, and the coupling signals respectively superpose the data voltage signals transmitted in the data lines to form superposing signals, each of the superposing signals comprising a first cusp wave part formed by the coupling signal and a square wave part formed by the data voltage signal, the signal processing units are configured to convert the square wave parts of the superposing signals into second cusp wave parts independent from the first cusp wave parts;

wherein the feedback line is configured to provide a feedback signal comprising an averaged first cusp wave part and an averaged second cusp wave part to a common voltage circuit, and the common voltage circuit provides a common voltage signal to the pixel units in accordance with the feedback signal.

10. The liquid crystal display of claim 9, wherein each pixel unit further comprises a pixel electrode, and the coupling signal is induced by the coupling element, the coupling element being a coupling capacitor connected between the pixel electrode and a corresponding one of data lines.

11. The liquid crystal display of claim 10, wherein each pixel unit further comprises a liquid crystal capacitor and a storage capacitor electrically coupled in parallel, a capacitance of the coupling capacitor is substantially the same as a sum of capacitances of the liquid crystal capacitor and the storage capacitor.

12. The liquid crystal display of claim 9, wherein each of the signal processing units comprises a differentiator for performing a differential calculation on the superposing signal, such that the square wave part of the superposing signal is converted to the second cusp wave part independent from the first cusp wave part of the superposing signal while the first cusp wave part of the superposing signal is bypassed.

13. The liquid crystal display of claim 12, further comprising a ground line parallel to the feedback line, wherein the signal processing units are disposed at dummy regions between the feedback line and the ground line.

14. The liquid crystal display of claim 13, further comprising a ground line, wherein the differentiator comprises a differential capacitor and a differential resistor, the differential capacitor is connected between the data line and the feedback line, and the differential resistor is connected between the feedback line and the ground line.

15. The liquid crystal display of claim 14, wherein the differential capacitor is a parasitic capacitor formed by a superposition of the data line and the feedback line.

16. The liquid crystal display of claim 15, wherein the differential resistor is a parasitic resistor of a wire configured for connecting the feedback line to the ground line.

17. The liquid crystal display of claim 9, wherein the common voltage circuit comprises a filter circuit and a compensating circuit, the filter circuit is configured to remove the averaged second cusp wave part from the feedback signal and extract the averaged first cusp wave part of the feedback signal to the compensating circuit, the compensating circuit is configured to compensate the common voltage signal according to the averaged first cusp wave part of the feedback signal.

18. A liquid crystal display, comprising:

a plurality of pixel units;

a scanning circuit configured to activate the pixel units;

a data circuit configured to provide data voltage signals to the activated pixel units via parallel data lines;

a plurality of signal processing units respectively connected to the data lines; and a common voltage circuit configured to generate a common voltage signal; and a feedback line electrically connected between the signal processing units and the common voltage circuit;

wherein each pixel unit comprises a coupling member for imposing a coupling signal that is generated in responsive to a corresponding one of the date voltage signals on the data line transmitting the data voltage signal, to form a superposing signal comprising a first cusp wave part formed by the coupling signal and a second square wave part formed by the data voltage signal, each of the signal processing units is configured to output a feedback signal comprising the first wave part and the second wave part to the common voltage circuit based on the superposing signal;

each of the signal processing units is configured to convert the square wave part of the superposing signal into a second cusp wave part that is independent from the first cusp wave part; the feedback line is configured to output a feedback signal comprises an averaged first cusp wave part and an averaged second cusp part to the common voltage circuit;

the common voltage circuit comprises a compensating circuit for compensating the common voltage signal based on the first wave part of the feedback signal.

19. The liquid crystal display of claim 18, wherein the common voltage circuit further comprises a filter circuit configured to remove the second cusp wave part from the feedback signal and extract the averaged first cusp wave part of the feedback signal to the compensating circuit.

* * * * *